US011721509B1

(12) United States Patent
Chiu et al.

(10) Patent No.: US 11,721,509 B1
(45) Date of Patent: Aug. 8, 2023

(54) EASY-TO-ASSEMBLE FUSE

(71) Applicant: CONQUER ELECTRONICS CO., LTD., New Taipei (TW)

(72) Inventors: Hung-Chih Chiu, New Taipei (TW); Po-Shuo Chiu, New Taipei (TW)

(73) Assignee: CONQUER ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/841,249

(22) Filed: Jun. 15, 2022

(30) Foreign Application Priority Data

Apr. 27, 2022 (TW) ..... 111116100

(51) Int. Cl.

| | |
|---|---|
| ***H01H 85/175*** | (2006.01) |
| ***H01H 85/044*** | (2006.01) |
| ***H01H 85/20*** | (2006.01) |
| ***H01H 85/47*** | (2006.01) |
| *H01H 85/041* | (2006.01) |

(52) U.S. Cl.
CPC ..... *H01H 85/044* (2013.01); *H01H 85/175* (2013.01); *H01H 85/1755* (2013.01); *H01H 85/2045* (2013.01); *H01H 85/47* (2013.01); *H01H 2085/0414* (2013.01)

(58) Field of Classification Search
CPC ..... H01H 85/044; H01H 85/175; H01H 85/1755; H01H 85/2045; H01H 85/22; H01H 85/47; H01H 2085/0412; H01H 2085/0414; H01H 2085/207; H01H 2085/2085
See application file for complete search history.

(56) References Cited

U.S. PATENT DOCUMENTS

| | | | | |
|---|---|---|---|---|
| 4,608,548 A * | 8/1986 | Borzoni | H01H 85/0417 | 337/201 |
| 4,894,633 A * | 1/1990 | Holtfreter | H01H 85/0411 | 337/201 |
| 5,055,071 A * | 10/1991 | Carlson | H01H 85/201 | 337/187 |
| 5,287,079 A * | 2/1994 | Bernardi | H01H 85/0417 | 337/250 |
| 5,648,750 A * | 7/1997 | Yuza | H01H 85/0411 | 337/252 |
| 11,404,234 B2 * | 8/2022 | Skrzypczak | H01H 85/201 | |

(Continued)

FOREIGN PATENT DOCUMENTS

| | | |
|---|---|---|
| CN | 207134321 U | 3/2018 |
| CN | 113675044 A | 11/2021 |
| TW | M631158 U | 8/2022 |

OTHER PUBLICATIONS

Search Report of Patent Application No. 111116100, 2 pages.

*Primary Examiner* — Jacob R Crum
(74) *Attorney, Agent, or Firm* — Muncy, Geissler, Olds & Lowe, P.C.

(57) ABSTRACT

An easy-to-assemble fuse has a fusible body, a socket, and a cover. The fusible body is engaged with the socket. The cover is covered on the socket and the fusible body and is engaged with the socket. By the engagement between the fusible body and the socket and the engagement between the socket and the cover, the fuse achieves the purpose of fast alignment and positioning. The fuse can be quickly assembled during the manufacturing process, thereby simplifying the manufacturing process, and reducing the production cost.

18 Claims, 13 Drawing Sheets

(56) References Cited

U.S. PATENT DOCUMENTS

| | | | | |
|---|---|---|---|---|
| 2003/0024105 | A1* | 2/2003 | Chiu | H01H 85/0411 29/857 |
| 2008/0184560 | A1* | 8/2008 | Pizzi | H01H 85/56 29/874 |
| 2009/0033453 | A1* | 2/2009 | Deno | H01H 85/547 337/205 |
| 2012/0133478 | A1* | 5/2012 | Chiu | H01H 85/165 337/228 |
| 2016/0111240 | A1 | 4/2016 | Beckert et al. | |
| 2019/0221397 | A1* | 7/2019 | de Leon | H01H 85/18 |
| 2019/0318894 | A1* | 10/2019 | Chiu | H01H 85/2045 |
| 2020/0388457 | A1* | 12/2020 | Liu | H01H 85/143 |
| 2021/0118639 | A1 | 4/2021 | Betti | |

* cited by examiner

EASY-TO-ASSEMBLE FUSE

CROSS-REFERENCE TO RELATED APPLICATIONS

This application is based upon and claims priority under 35 U. S. C. 119 from Taiwan Patent Application No. 111116100 filed on Apr. 27, 2022, which is hereby specifically incorporated herein by this reference thereto.

BACKGROUND OF THE INVENTION

1. Field of the Invention

The present disclosure relates to a fuse, especially to a fuse mounted on the circuit to protect circuit safety.

2. Description of the Prior Arts

A conventional fuse in accordance with the prior arts has a fusible body disposed in a casing, and then fixed by the encapsulation. However, the position of the fusible body assembled in the casing is easily moved by the external force during manufacturing so that fixing the position of the fusible body is difficult. The unstable location of the fusible body affects its function. For instance, the distance between both ends of the fusible body is not fixed. When the ends of the fusible body are too close, the fusible body may generate arc when melted. Then the fuse is unable to form an open circuit at once. For another instance, the distance between the fusible body and the wall of the casing also causes a different influence on the fusible body in reacting to the external temperature. Then the fuse can not respond to exceeding temperature because of excessive current at once so that the fuse is unable to form an open circuit at once.

Therefore, how to fix the position of the fusible body inside the casing is a technical problem in the field of the invention.

SUMMARY OF THE INVENTION

In view of the shortcomings of the above fuse, the main objective of the present disclosure is to provide an improved easy-to-assemble fuse to fix the position of fusible body during manufacturing. Further, to obviate shortcoming due to the position of the aforementioned fuse is not fixed.

The main technical features used to achieve the objective of the invention is that the easy-to-assemble fuse includes:

a fusible body having a fusible part, two connecting parts and two terminals, both ends of the fusible part respectively connecting to the connecting parts, both ends of each connecting part respectively connecting to the fusible part and one of the terminals;

a socket receiving the fusible body having a receiving seat having two sides and two indentations, the indentations respectively formed through the sides of the receiving seat, the fusible part of the fusible body mounted through the receiving seat and received in the indentations; and two end seats respectively extending outward from the sides of the receiving seat and aligning with the indentations, wherein a height of the receiving seat is higher than a height of the end seats, and each end seat having an end;

a first surface and a second surface being opposite to each other, wherein the connecting parts of the fusible body are respectively disposed on the first surfaces of the end seats, the terminals of the fusible body are respectively bent along the ends and the second surfaces of the end seats; and a cover mounted on the fusible body and the socket having a main wall having a peripheral edge;

an annular wall formed around the peripheral edge of the main wall;

an inner chamber defined between and surrounded by the main wall and the annular wall; and at least one positioning element disposed on the main wall and extending into the inner chamber, and the positioning element is engaged with at least one of the indentations of the receiving seat of the socket.

The present invention includes at least the advantages described below. The fusible body and the socket can be easily aligned through the cooperation of the fusible part and the receiving seat. Similarly, the socket and the cover can be easily aligned through the configuration of the receiving seat and the positioning element. A specialized equipment is unnecessary to assist alignment and assembly. Therefore, the assembly time is efficiently reduced and further lower the manufacturing cost of the fuse as described.

DETAILED DESCRIPTION OF THE EMBODIMENTS

With reference to the attached drawings, the present invention is described by means of the embodiments below where the attached drawings are simplified for illustration purposes only to illustrate the structures or methods of the present invention by describing the relationships between the components and assembly in the present invention. Therefore, the components shown in the figures are not expressed with the actual numbers, actual shapes, or actual dimensions, nor with the actual ratio. Some of the dimensions or dimension ratios have been enlarged or simplified to provide a better illustration. The actual numbers, actual shapes, or actual dimension ratios can be selectively designed and disposed, and the detailed component layouts may be more complicated.

Figure 1:
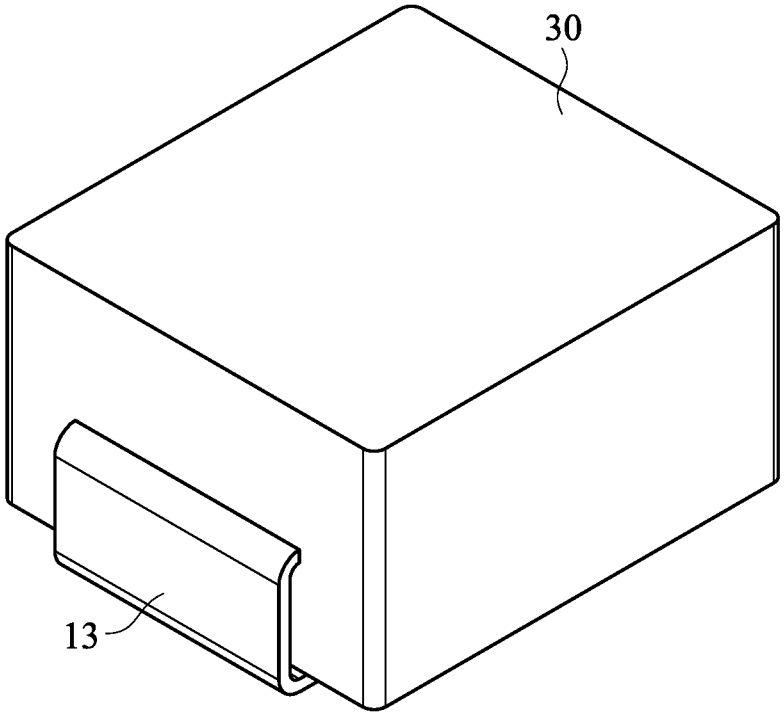
FIG. 1 is a perspective top view of a first embodiment of a fuse in accordance with the present invention.
Figure 2:
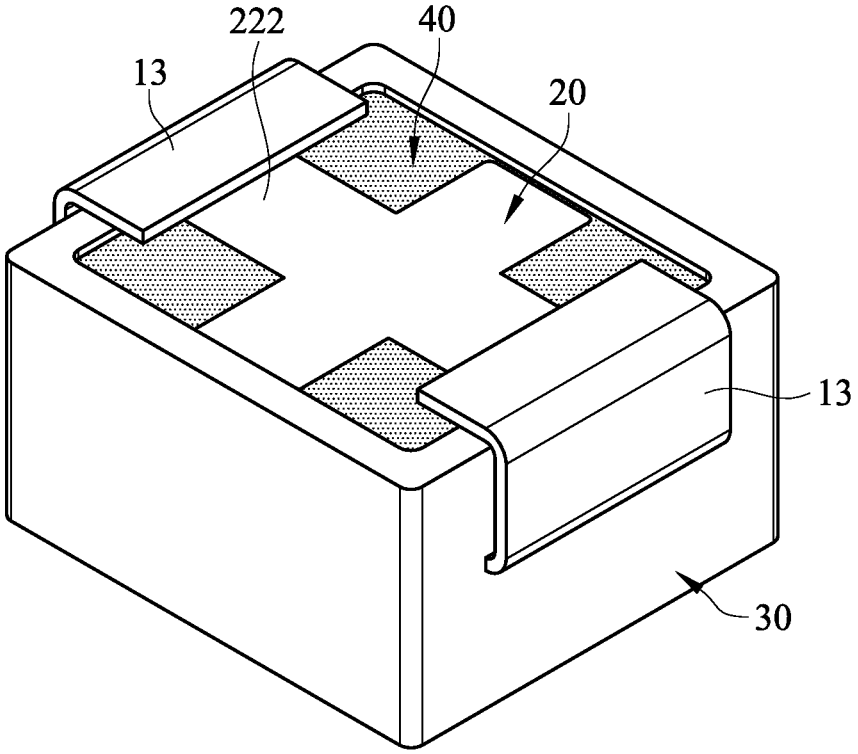
FIG. 2 is a perspective bottom view of the fuse in FIG. 1.
Figure 3:
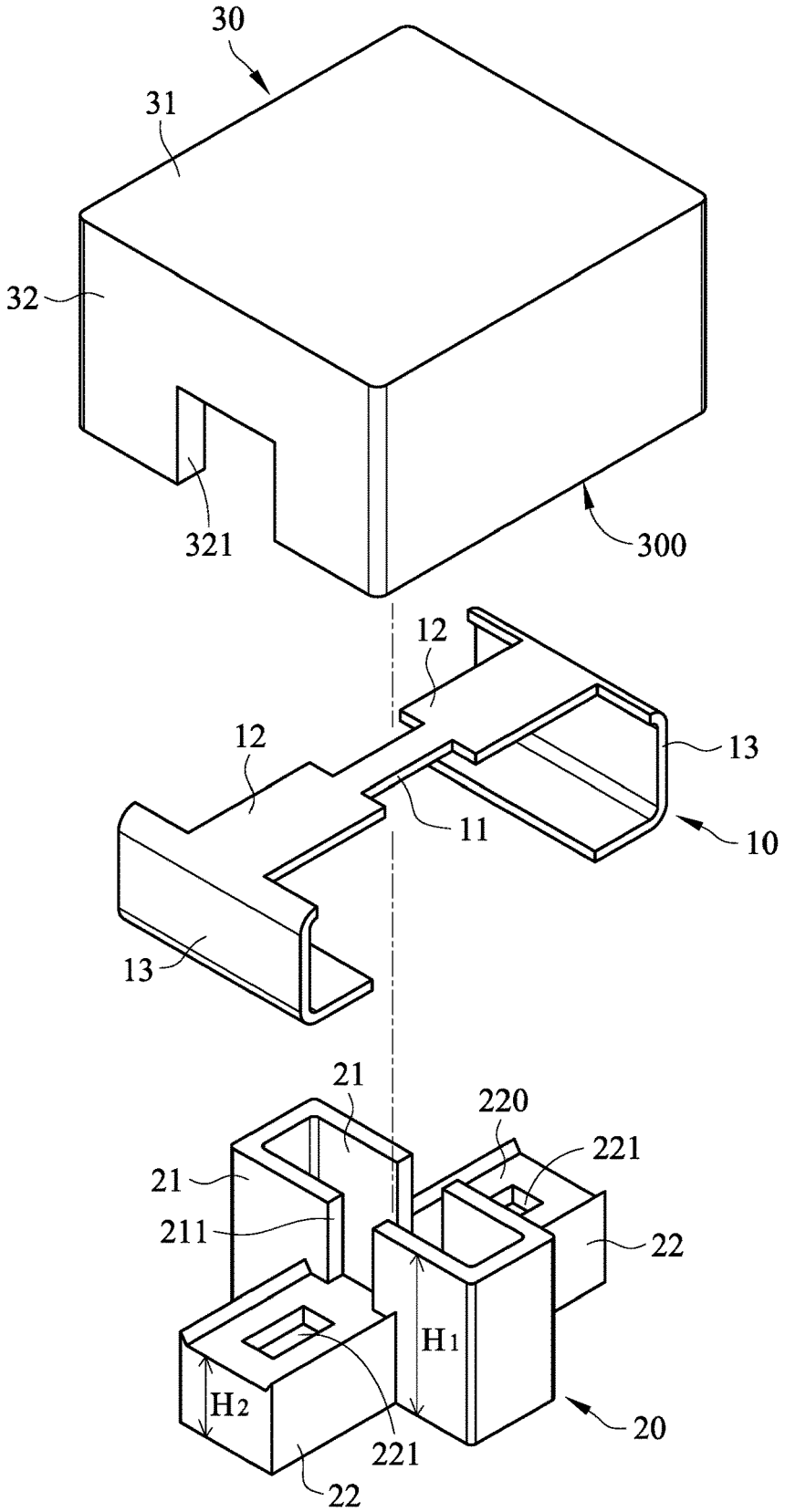
FIG. 3 is an exploded perspective view of the fuse in FIG. 1.

With reference to FIGS. 1 to 3, an easy-to-assemble fuse in accordance with the present invention includes a fusible body 10, a socket 20, a cover 30 and an encapsulant 40.

Figure 4A:
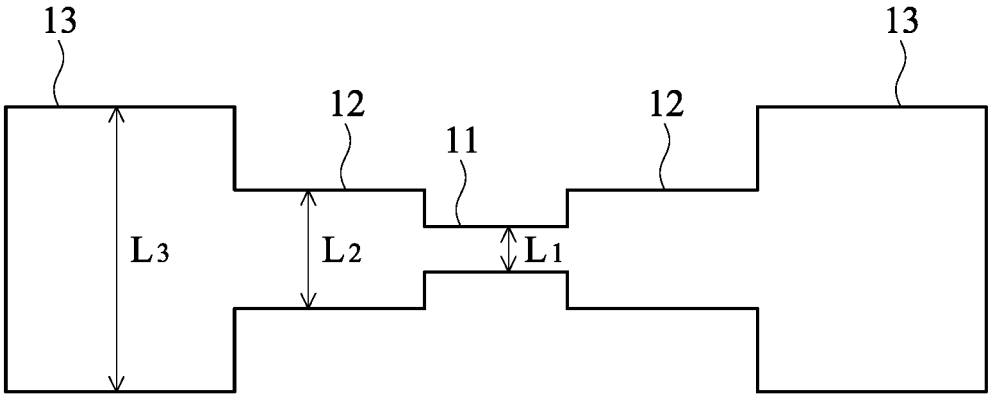
FIG. 4A is a top view of a first embodiment of a fusible body of the fuse in FIG. 1.

The fusible body 10 includes a fusible part 11, two connecting parts 12 and two terminals 13. Both ends of the fusible part 11 respectively connect to the connecting parts 12. Both ends of each connecting part 12 respectively connect to the fusible part 11 and one of the terminals 13. In one embodiment as shown in FIG. 4A, a width $L_1$ of the fusible part 11 is smaller than a width $L_2$ of the connecting parts 12. The width $L_2$ of the connecting parts 12 is smaller than a width $L_3$ of the terminals 13.

Figure 4B:
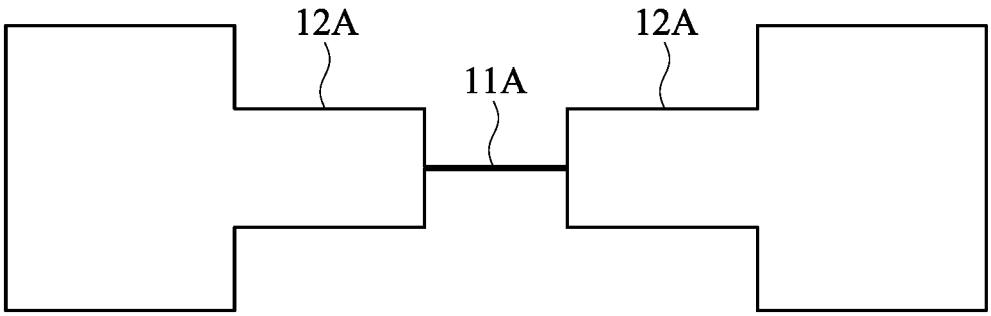
FIG. 4B is a top view of a second embodiment of a fusible body of a fuse in accordance with the present invention.
Figure 4C:
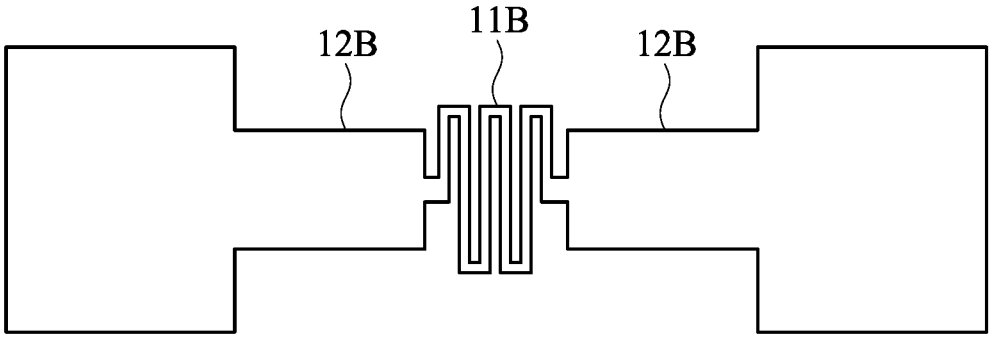
FIG. 4C is a top view of a third embodiment of a fusible body of a fuse in accordance with the present invention.
Figure 4D:
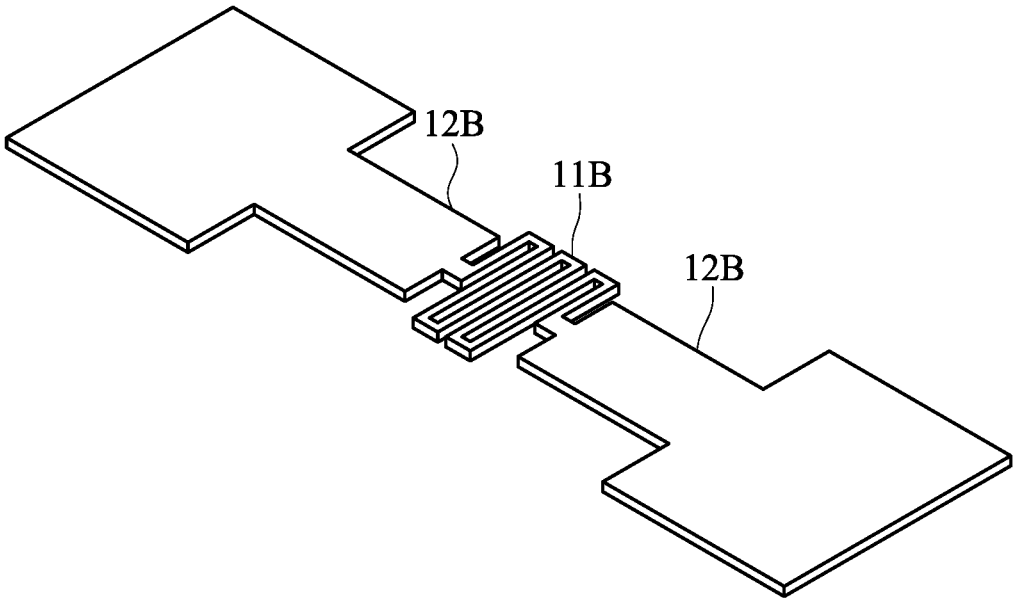
FIG. 4D is a perspective view of the fusible body in FIG. 4C.

In one embodiment as shown in FIG. 4A, the fusible part 11, the connecting parts 12 and the terminals 13 are formed integrally. In another embodiment as shown in FIG. 4B, the fusible part 11A is attached to the connecting parts 12A by welding. In one embodiment as shown in FIG. 4A, the fusible part 11 is linear. In another embodiment as shown in FIG. 4C and FIG. 4D, the fusible part 11B is bent in a non-linear path. Therefore, a length of the fusible part 11B is elongated without increasing the distance between the connecting parts 12B. The fuse of this embodiment is used for protecting a circuit with smaller rated current (for example, 10 A to 0.5 A). Further, both sides of the fusible part 11B may be bent downward to reduce a width of the fusible part 11B.

Figure 5:
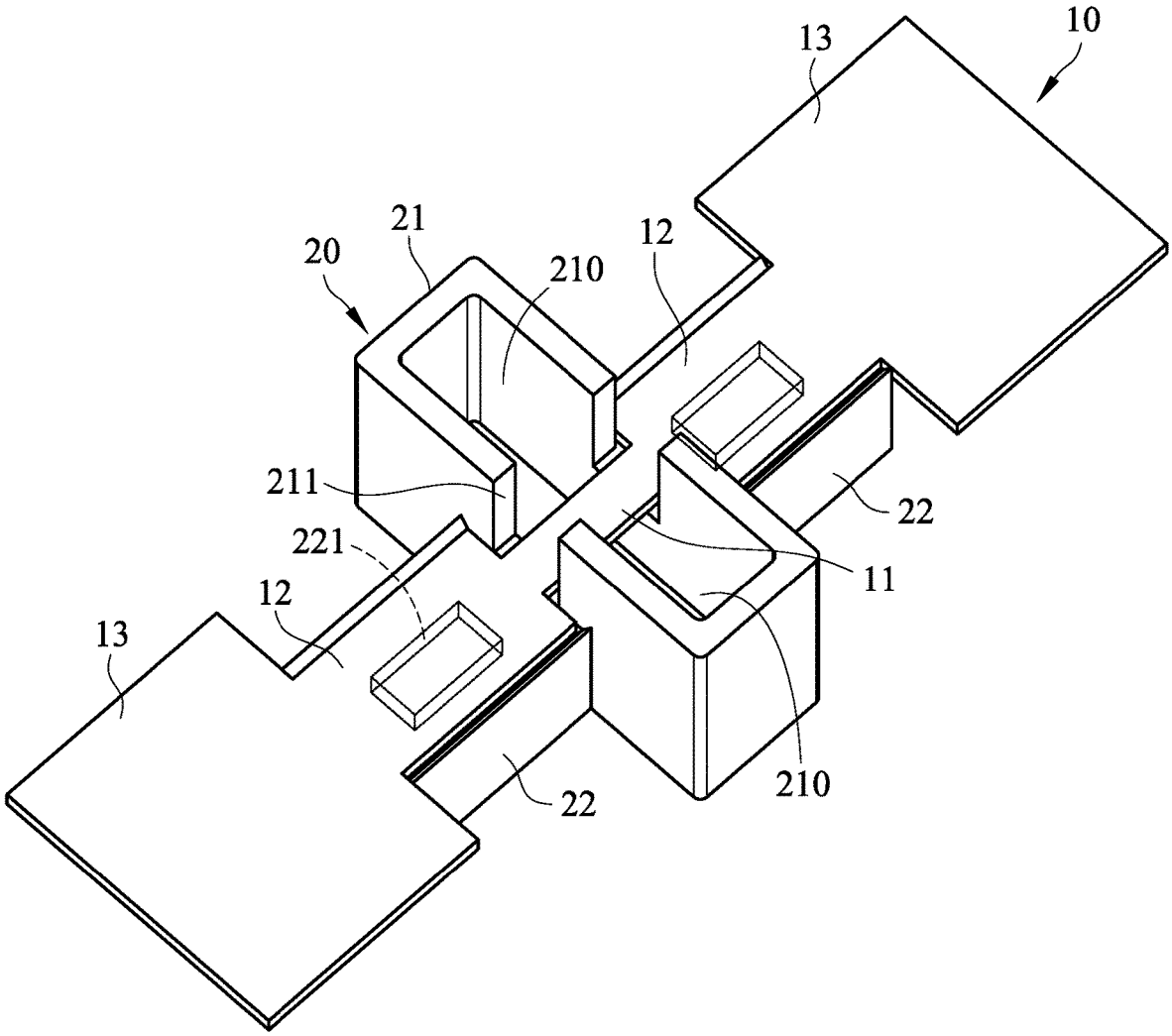
FIG. 5 is an assembly view of the fusible body in FIG. 4A and a socket of the fuse in FIG. 1.

With reference to FIGS. 2, 3 and 5, the socket 20 receives the fusible body 10 and includes a receiving seat 21 and two end seats 22. A height $H_1$ of the receiving seat 21 is larger than a height $H_2$ of the end seats 22. The receiving seat 21 is hollow and has two sides, a heat gathering chamber 210 and two indentations 211. The heat gathering chamber 210 is formed inside the receiving seat 21. The indentations 211 are formed respectively through the sides of the receiving seat 21 and communicate with the heat gathering chamber 210. The fusible part 11 of the fusible body 10 is mounted through the receiving seat 21 and is received in the indentations 211. The end seats 22 respectively extend outward from the sides of the receiving seat 21 and align with the indentations 211. Each end seat 22 has an end, a first surface 220, a second surface 222 and a heat gathering recess 221. The first surface 220 and the second surface 222 are opposite to each other. The heat gathering recesses 221 are respectively formed on the first surfaces 220. The connecting parts 12 of the fusible body 10 are respectively disposed on the first surfaces 220 of the end seats 22, and the heat gathering recesses 221 are respectively overlaid with the connecting parts 12. The terminals 13 of the fusible body 10 are respectively bent along the ends and the second surfaces 222 of the end seats 22. The heat gathering chamber 210 and the heat gathering recesses 221 provide a space for accumulating heat. Due to the fusible part 11 is adjacent to the heat gathering chamber 210 and the connecting parts 12 of the fusible body 10 are respectively adjacent to the heat gathering recesses 211, the heat accumulated in the heat gathering chamber 210 and the heat gathering recesses 221 is efficiently transferred to the fusible part 11 and the connecting parts 12 of the fusible body 10. When the fusible body 10 encounters exceeding current, the heat generated in an instant is rapidly transferred to the fusible part 11 and the connecting parts 12 of the fusible body 10 through the heat gathering chamber 210 and the heat gathering recesses 211. Thus, the fusible part 11 is melted in reacting to overheat, to further improve the effect in protection of the overall circuit.

Figure 6A:
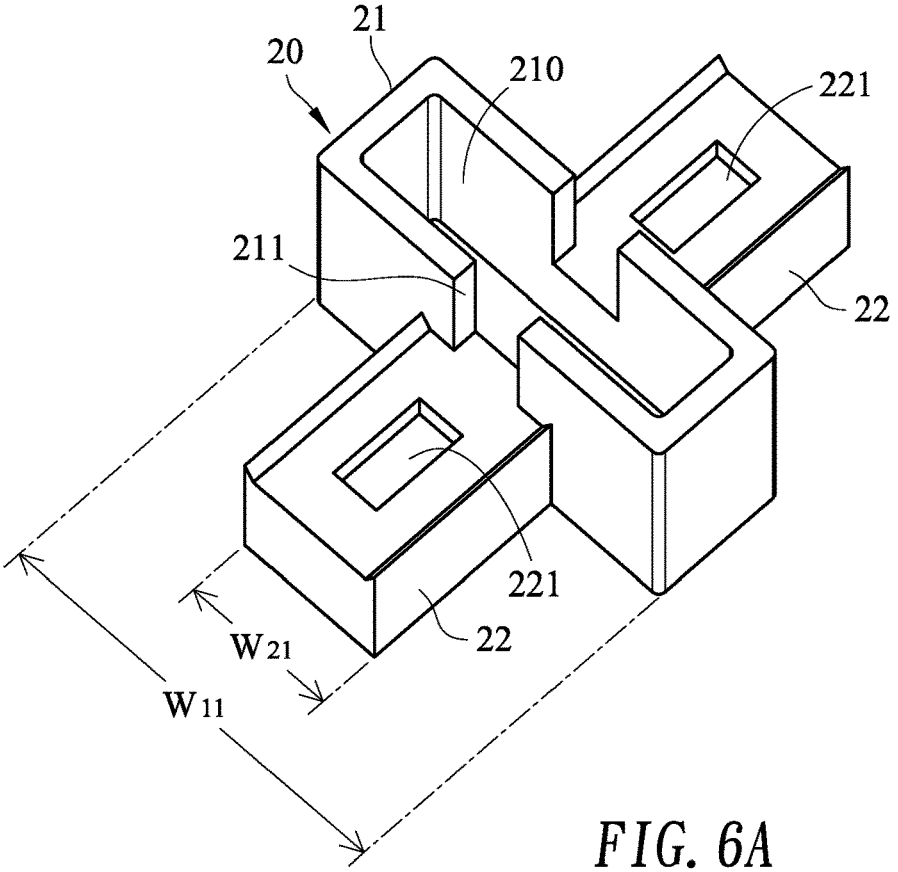
FIG. 6A is a perspective view of a first embodiment of a socket of the fuse in FIG. 1.
Figure 6B:
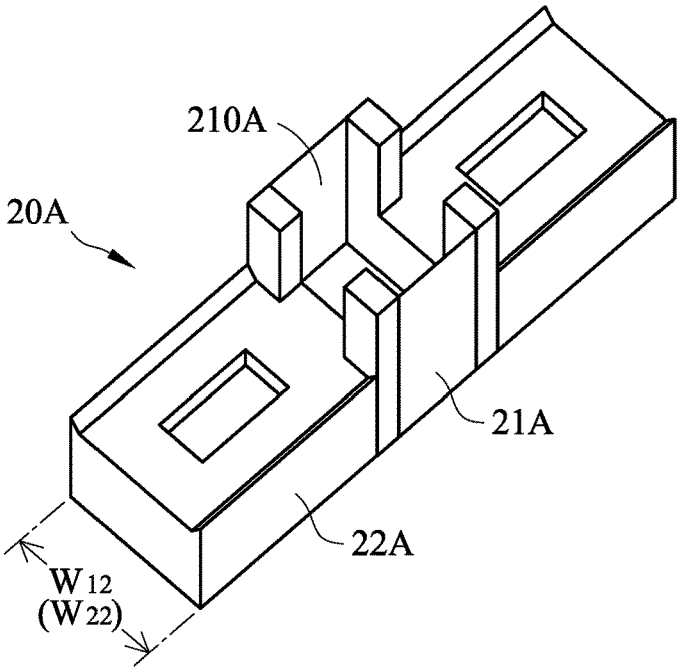
FIG. 6B is a perspective view of a second embodiment of a socket of a fuse in accordance with the present invention.

In one embodiment, as shown in FIG. 6A, a width $W_{11}$ of the receiving seat 21 is greater than a width $W_{21}$ of each end seat 22. In another embodiment, as shown in FIG. 6B, a width $W_{12}$ of the receiving seat 21A is equal to a width $W_{22}$ of each end seat 22A. Compared to aforementioned two embodiments, the heat gathering chamber 210 of the embodiment as shown in FIG. 6A has more space than the heat gathering chamber 210A of the embodiment shown in FIG. 6B, so the receiving seat 21 of the embodiment shown in FIG. 6A provides not only better heat accumulating effect but more space for melting the fusible part 11. By comparison, the socket 20A of the embodiment shown in FIG. 6B has less volume than the socket 20 of the embodiment shown in FIG. 6A.

Figure 7:
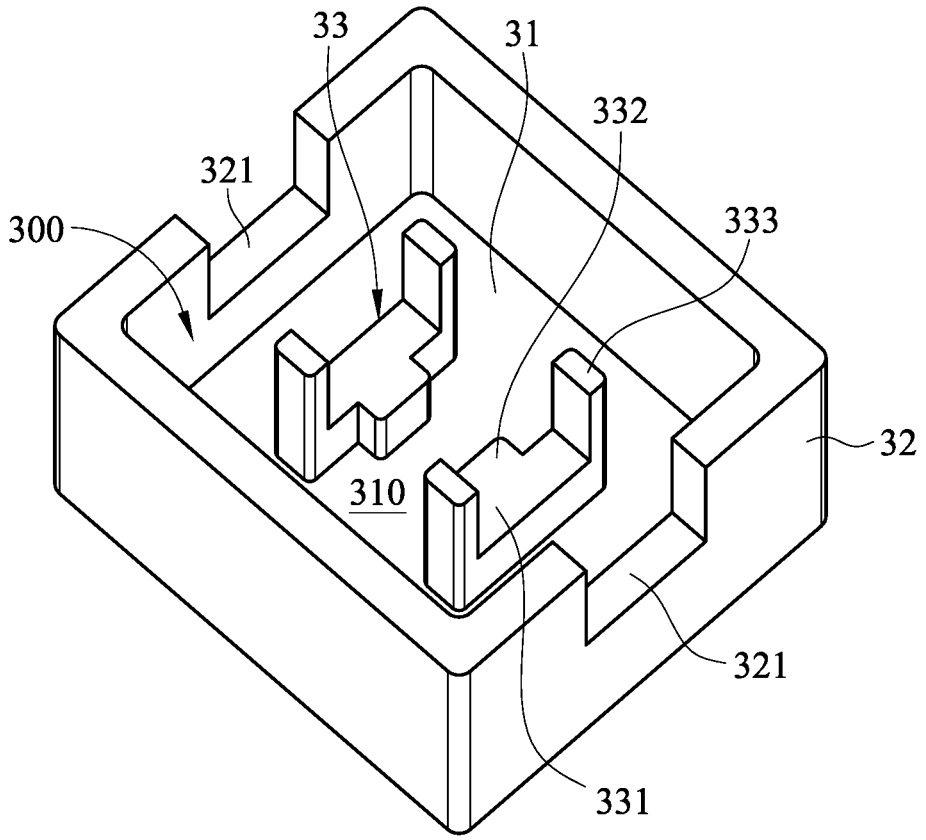
FIG. 7 is a perspective top view of a cover of the fuse in FIG. 1.
Figure 8:
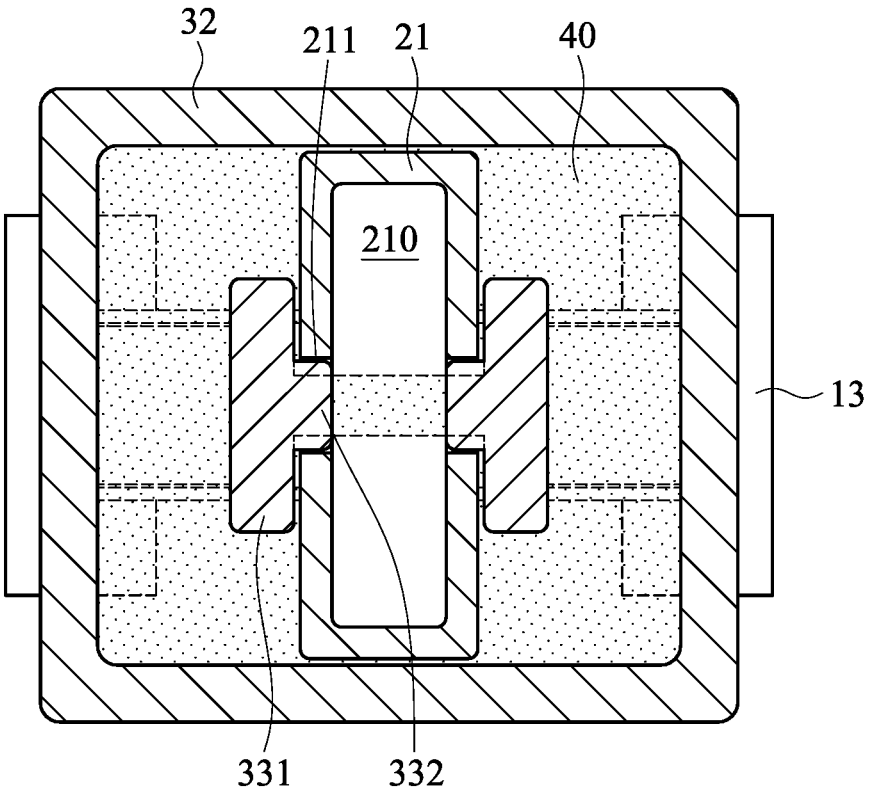
FIG. 8 is a top view in partial section of the fuse in FIG. 1.
Figure 9:
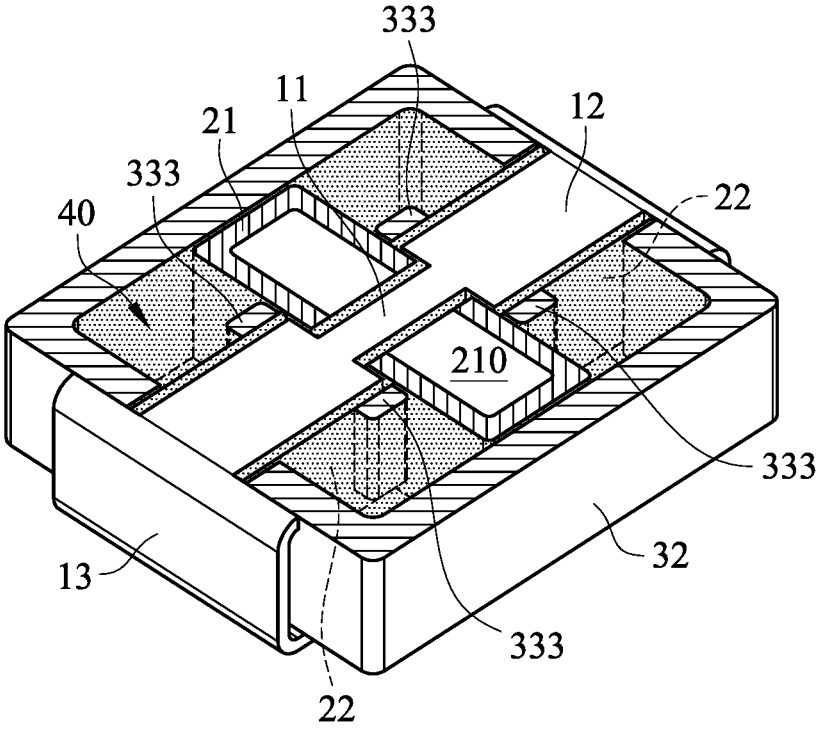
FIG. 9 is a perspective top view in partial section of the fuse in FIG. 1.

With reference to FIGS. 3, 7 and 9, the cover 30 is mounted on the fusible body 10 and the socket 20. The cover 30 includes a main wall 31, an annular wall 32, an inner chamber 310, an opening 300 and at least one positioning element 33. The annular wall 32 is formed around a peripheral edge of the main wall 31. The inner chamber 310 is defined between and is surrounded by the main wall 31 and the annular wall 32. The opening 300 is opposite to the main wall 31, is adjacent to the annular wall 32 and communicates with the inner chamber 310. The main wall 31 is attached to an edge of the receiving seat 21 of the socket 20 to seal the heat gathering chamber 210 between the receiving seat 21 and the main wall 31. The annular wall 32 has two notches 321 formed adjacent to the opening 300 and are respectively corresponding to the terminals 13 of the fusible body 10. The terminals 13 respectively extend outward from the notches 321. The positioning element 33 is disposed on the main wall 31 and extends into the inner chamber 310. The positioning element 33 is engaged with at least one of the indentations 211 of the receiving seat 21, so that the cover 30 and the socket 20 is positioned to each other. In one embodiment, each positioning element 33 includes a main body 331, a protrusion 332 and two barriers 333. The main body 331, the protrusion 332 and the barriers 333 are disposed on the main wall 31. The protrusion 332 is formed on the main body 331 and extends along one side of the main wall 31 The barriers 333 are respectively formed on both ends of the main body 331 and extend to the inner chamber 310. The protrusion 332 is engaged with a corresponding indentation 211 of the receiving seat 21. The barriers 333 respectively abut against the sides of the end seats 22 of the receiving seat 20 Thus, the engagement between the cover 30 and the socket 20 is strengthened.

Figure 10:
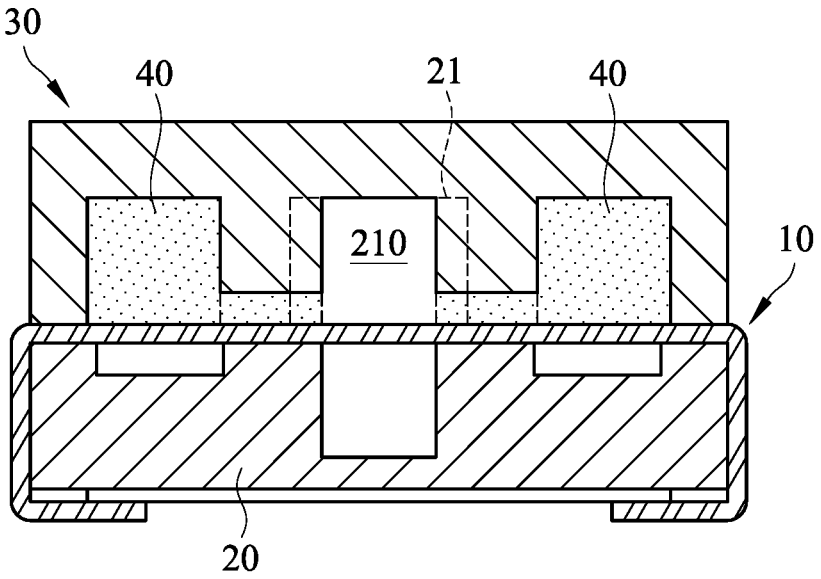
FIG. 10 is a side view in partial section of the fuse in FIG. 1.
Figure 11:
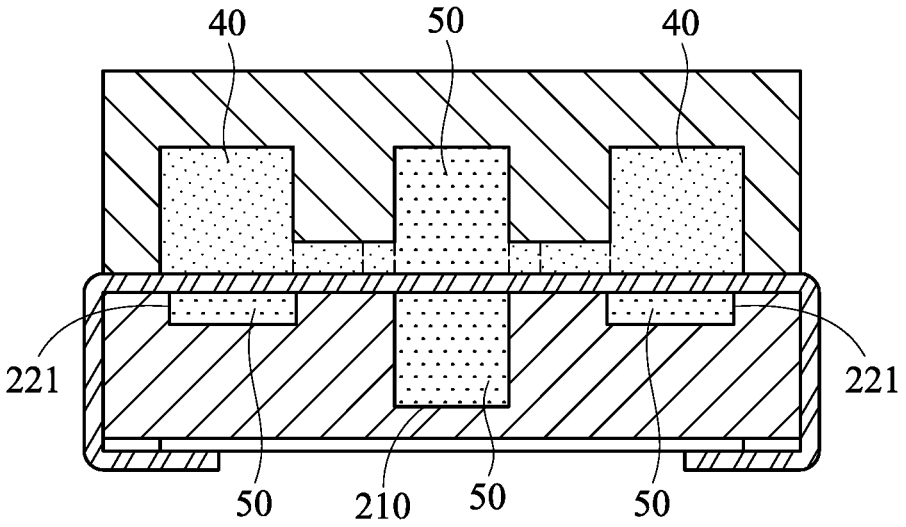
FIG. 11 is a side view in partial section of a second embodiment of a fuse in accordance with the present invention.

With reference to FIGS. 2, 3 and 10, the encapsulant 40 is filled into the inner chamber 310 of the cover 30 through the opening 300 for additionally fixing the fusible body 10, the socket 20 and the cover 30. Due to the heat gathering chamber 210 of the socket 20 is sealed by the main wall 31 of the cover 30, the heat gathering chamber 210 is not filled by encapsulant 40. Similarly, due to the heat gathering recesses 221 of the socket 20 are respectively covered with the connecting parts 12 of the fusible body 10, the heat gathering recesses 221 are not filled by the encapsulant 40. In one embodiment, the encapsulant 40 may be a heat resistant material. For example, the encapsulant 40 may be an epoxy resin, a silicone resin, or similar materials. In one embodiment as shown in FIG. 11, an explosion-proof material 50 may be prefilled in the heat gathering chamber 210 and the heat gathering recesses 221. For example, the explosion-proof material 50 may be a quartz sand, an explosion-proof sand, a flame retardant, or similar materials. The flame retardant may be a melamine, a magnesium hydroxide, an aluminum hydroxide, or similar material. When the fusible body 10 encounters exceeding current and starts melting by the massive heat, the explosion-proof material 50 keeps the flame from generating by the fusible body 10.

Figure 12:
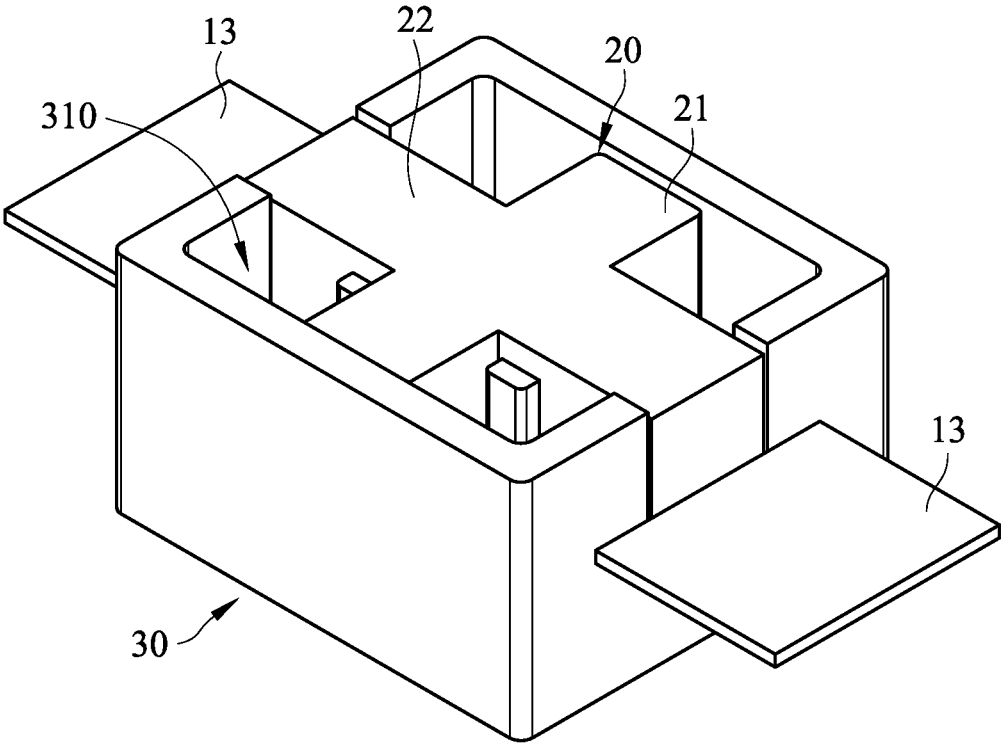
FIG. 12 is an operational perspective bottom view of the fuse in FIG. 1, shown assembling.

In the assembling and the manufacturing process of the fuse as described, the fusible body 10 is first received in the socket 20 as shown in FIG. 5. Through engaging the fusible part 11 with the indentation 211, the connecting parts 12 are naturally located on the end seats 22. Thus, the fusible body 10 and the socket 20 is positioned and located easily. Then, as shown in FIG. 12 and with reference to FIGS. 3 and 7, the cover 30 is disposed on the fusible body 10 and the socket 20. Through engagement of the positioning element 33 and the indentation 211 of the receiving seat 21, the cover 30 and the socket 20 are positioned to each other. Finally, as shown in FIG. 2, the encapsulant 40 is filled into the inner chamber 310 of the cover 30, and the terminals 13 are respectively bent to attach the ends and the second surfaces 222 of the end seats 22 Then the relative positions of the fusible body 10, the socket 20 and the cover 30 are fixed. Therefore, through the cooperation of the fusible part 11, the receiving seat 21 and the positioning element 33, the fusible body 10, the socket 20 and the cover 30 are easily aligned with each other when assembling. Using additional precise alignment instrument is unnecessary to achieve the alignment, so that the assembling time and the cost of the fuse as described are effectively saved.

In another embodiment, the cover 30 and the socket 20 are positioned each other by interference fit without using the encapsulant 40. Both the cover 30 and the socket 20 may be plastic material to achieve interference fit easier.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fuse comprising:

a fusible body having a fusible part, two connecting parts and two terminals, both ends of the fusible part respectively connecting to the connecting parts, and both ends of each connecting part respectively connecting to the fusible part and one of the terminals;

a socket receiving the fusible body having a receiving seat having two sides; and two indentations respectively formed through the sides of the receiving seat, and the fusible part of the fusible body mounted through the receiving seat and received in the indentations; and two end seats respectively extending outward from the sides of the receiving seat and respectively aligning with the indentations, wherein a height of the receiving seat is larger than a height of the end seats, and each end seat having an end;

a first surface and a second surface being opposite to each other, wherein the connecting parts of the fusible body are respectively disposed on the first surfaces of the end seats, the terminals of the fusible body are respectively bent along the ends and the second surfaces of the end seats; and a cover mounted on the fusible body and the socket having a main wall having a peripheral edge;

an annular wall formed around the peripheral edge of the main wall;

an inner chamber defined between and surrounded by the main wall and the annular wall; and at least one positioning element disposed on the main wall and extending into the inner chamber, and the positioning element is engaged with at least one of the indentations of the receiving seat of the socket.

2. The fuse as claimed in claim 1, wherein the receiving seat is hollow and has a heat gathering chamber;

the indentations communicate with the heat gathering chamber; and the main wall is attached to an edge of the receiving seat of the socket to seal the heat gathering chamber between the receiving seat and the main wall.

3. The fuse as claimed in claim 1, wherein each end seat has a heat gathering recess formed on the first surface; and the heat gathering recesses are respectively overlaid with the connecting parts of the fusible body.

4. The fuse as claimed in claim 2, wherein each end seat has a heat gathering recess formed on the first surface; and the heat gathering recesses are respectively overlaid with the connecting part of the fusible body.

5. The fuse as claimed in claim 1 further comprising an encapsulant, wherein the cover further has an opening opposite to the main wall, adjacent to the annular wall and communicating with the inner chamber; and the encapsulant filled into the inner chamber of the cover through the opening of the cover.

6. The fuse as claimed in claim 2 further comprising an encapsulant, wherein the cover further has an opening opposite to the main wall, adjacent to the annular wall, and communicating with the inner chamber; and the encapsulant filled into the inner chamber of the cover through the opening.

7. The fuse as claimed in claim 3 further comprising an encapsulant, wherein the cover has an opening opposite to the main wall, adjacent to the annular wall, and communicating with the inner chamber; and the encapsulant filled into the inner chamber of the cover through the opening.

8. The fuse as claimed in claim 4 further comprising an encapsulant, wherein the cover has an opening opposite to the main wall, adjacent to the annular wall, and communicating with the inner chamber; and the encapsulant filled into the inner chamber of the cover through the opening.

9. The fuse as claimed in claim 5, wherein the annular wall has two notches formed adjacent to the opening and respectively corresponding to the terminals of the fusible body; and the terminals respectively extend outward from the notches.

10. The fuse as claimed in claim 6, wherein the annular wall has two notches formed adjacent to the opening and respectively corresponding to the terminals of the fusible body; and the terminals respectively extend outward from the notches.

11. The fuse as claimed in claim 7, wherein the annular wall has two notches formed adjacent to the opening and respectively corresponding to the terminals of the fusible body; and the terminals respectively extend outward from the notches.

12. The fuse as claimed in claim 8, wherein the annular wall has two notches formed adjacent to the opening and respectively corresponding to the terminals of the fusible body; and the terminals respectively extend outward from the notches.

13. The fuse as claimed in claim 1, wherein a width of the receiving seat of the socket is greater than or equal to a width of the end seats.

14. The fuse as claimed in claim 2, wherein a width of the receiving seat of the socket is greater than or equal to a width of the end seats.

15. The fuse as claimed in claim 1, wherein the fusible part, the connecting parts and the terminals of the fusible body are formed integrally.

16. The fuse as claimed in claim 2, wherein the fusible part, the connecting parts and the terminals of the fusible body are formed integrally.

17. The fuse as claimed in claim 1, wherein the fusible part is bent in a non-linear path.

18. The fuse as claimed in claim 2, wherein the fusible part is bent in a non-linear path.

* * * * *